US009643746B1

(12) United States Patent
Lunn

(10) Patent No.: US 9,643,746 B1
(45) Date of Patent: May 9, 2017

(54) SYSTEM AND METHOD OF TRANSFERRING MATTER THROUGH A SEALED CONTAINER

(71) Applicant: Paul E. Lunn, Atlanta, GA (US)

(72) Inventor: Paul E. Lunn, Atlanta, GA (US)

( * ) Notice: Subject to any disclaimer, the term of this patent is extended or adjusted under 35 U.S.C. 154(b) by 0 days.

(21) Appl. No.: 15/271,038

(22) Filed: Sep. 20, 2016

(51) Int. Cl.

| | |
|---|---|
| ***B65B 31/08*** | (2006.01) |
| ***B65B 31/06*** | (2006.01) |
| ***B65B 31/04*** | (2006.01) |
| ***B67C 3/22*** | (2006.01) |
| ***B67C 3/14*** | (2006.01) |
| ***B65B 31/00*** | (2006.01) |

(52) U.S. Cl.
CPC ..... *B65B 31/08* (2013.01); *B65B 31/006* (2013.01); *B65B 31/046* (2013.01); *B65B 31/06* (2013.01); *B67C 3/14* (2013.01); *B67C 3/22* (2013.01); *B67C 3/222* (2013.01); *B67C 2003/226* (2013.01)

(58) Field of Classification Search
CPC .. B67C 3/14; B67C 3/16; B67C 3/222; B67C 2003/226; B65B 31/006; B65B 31/025; B65B 31/027; B65B 31/041; B65B 31/042; B65B 31/046; B65B 31/06; B65B 31/08; B65B 51/225
USPC ..... 53/432, 468, 50, 510
See application file for complete search history.

(56) References Cited

U.S. PATENT DOCUMENTS

| | | | | | |
|---|---|---|---|---|---|
| 2,855,006 | A | * | 10/1958 | Geisler | B65B 31/08 141/11 |
| 2,862,528 | A | * | 12/1958 | Geisler | B65B 31/044 141/39 |
| 2,930,170 | A | * | 3/1960 | Holsman et al. | B65B 31/08 53/268 |
| 3,299,603 | A | * | 1/1967 | Shaw | B65B 31/08 206/484 |
| 3,996,725 | A | * | 12/1976 | Walles | B65B 31/027 53/101 |
| 4,067,366 | A | * | 1/1978 | Conway et al. | B65B 31/08 141/198 |
| 4,513,015 | A | | 4/1985 | Clough | |
| 4,627,336 | A | | 12/1986 | Nam | |
| 4,703,609 | A | | 11/1987 | Yoshida et al. | |
| 5,244,117 | A | | 9/1993 | Lombardo | |
| 5,251,424 | A | * | 10/1993 | Zenger et al. | B65B 31/006 53/431 |
| 5,860,461 | A | * | 1/1999 | Helmut | B65B 51/142 141/1 |
| 6,018,932 | A | * | 2/2000 | Eberhardt, Jr. et al. | B65B 31/08 53/432 |

(Continued)

*Primary Examiner* — Stephen F Gerrity
(74) *Attorney, Agent, or Firm* — PK Patent Law

(57) ABSTRACT

A method and system of transferring matter through a sealed container during a bottling process are provided. The method includes accessing a headspace of the filled and sealed container by creating at least one opening. An inert gas is provided within the headspace while allowing $O_2$ to exit from the headspace until substantially all of the $O_2$ has been flushed out of the headspace. The headspace is then pressurized by continuing to direct the inert gas into the headspace after it has been flushed of $O_2$. The at least one opening of the container is then sealed while the headspace is under pressure. The filled and sealed container can be a hot-filled container.

20 Claims, 9 Drawing Sheets

(56) References Cited

U.S. PATENT DOCUMENTS

| | | | | |
|---|---|---|---|---|
| 6,155,027 | A * | 12/2000 | Brooks | H01L 21/67393 53/432 |
| 6,395,229 | B1 | 5/2002 | Markelov | |
| 6,395,560 | B1 | 5/2002 | Markelov | |
| 6,481,185 | B1 * | 11/2002 | Buchko | B65B 25/001 53/381.2 |
| 7,104,033 | B2 | 9/2006 | Krulitsch | |
| 7,146,781 | B1 * | 12/2006 | Cole | B65B 3/003 53/267 |
| 7,159,374 | B2 | 1/2007 | Abercrombie, III et al. | |
| 7,311,125 | B2 | 12/2007 | Krulitsch | |
| 7,637,082 | B2 | 12/2009 | Abercrombie, III et al. | |
| 7,726,352 | B2 * | 6/2010 | Py et al. | A61J 1/1406 141/11 |
| 8,309,622 | B2 | 11/2012 | Schmidt et al. | |
| 8,365,946 | B2 | 2/2013 | Abercrombie et al. | |
| 8,671,655 | B2 | 3/2014 | Abercrombie, III et al. | |
| 9,051,098 | B2 | 6/2015 | Abercrombie, III et al. | |
| 2009/0071106 | A1 * | 3/2009 | Sjoholm | B65B 55/18 53/432 |
| 2011/0094618 | A1 | 4/2011 | Melrose | |
| 2012/0009308 | A1 | 1/2012 | Keller | |
| 2012/0279180 | A1 | 11/2012 | Crawford et al. | |
| 2012/0311966 | A1 | 12/2012 | Melrose | |
| 2013/0055679 | A1 | 3/2013 | Melrose | |
| 2013/0239522 | A1 | 9/2013 | Melrose | |
| 2013/0247513 | A1 | 9/2013 | Melrose | |
| 2013/0291494 | A1 | 11/2013 | Melrose | |
| 2014/0260100 | A1 * | 9/2014 | Taber et al. | B65B 31/06 53/436 |
| 2015/0044337 | A1 | 2/2015 | Keller | |
| 2015/0121807 | A1 * | 5/2015 | Taber et al. | B65B 31/006 53/431 |
| 2015/0266600 | A1 * | 9/2015 | Haimi | B65B 31/046 53/408 |

* cited by examiner

SYSTEM AND METHOD OF TRANSFERRING MATTER THROUGH A SEALED CONTAINER

FIELD OF THE INVENTION

The present teachings relate to a system and method of transferring matter through a sealed container during a bottling process. In particular, the present teachings relate to flushing, pressurizing, and sealing a container after performing a hot-fill bottling process.

BACKGROUND OF THE INVENTION

In the beverage industry, it is known to fill non-carbonated beverages such as teas, juices, sports drinks, and other flavored beverages, into a plastic container or bottle at an elevated temperature (for example, at about 185° F. or 85° C.) in order to commercially sterilize the container's headspace and the beverage. This is commonly referred to as a hot-fill process.

However, after filling, sealing, and cooling the hot-filled bottle, an internal vacuum can force the bottle to collapse and deform. To mitigate this, hot-filled bottles have been provided with thicker side walls, special reinforcing structures, and/or special active bottle bases to compensate for these internal forces. The additional bottle material required to resist buckling increases weight and material cost compared to bottles for water or carbonated beverages. The design features required to mitigate the vacuum effects also impede bottle design freedom.

As the industry moves towards light-weighting of non-carbonated plastic bottles, top load resistance of the package is proportionately reduced which effectively lowers the permissible stack height during transport and warehousing of the product.

Another consideration when light-weighting bottles is the reduction in the sidewall thickness. Thinner sidewalls can increase the $O_2$ permeation rate, thus accelerating product spoilage and reducing shelf life.

Several known solutions have been employed to help solve vacuum-related problems encountered during the hot-fill process.

For example, a commonly used technology is the implementation of vacuum panels positioned on the side of the bottle which are designed to move toward the center of the bottle after cooling. This sidewall movement displaces the volume within the bottle to compensate for the vacuum generated. The panels are 'self-activated' in that the vacuum within the container induces the panels to function. This technology has been successful for several years for the light-weighting of bottles. Some of these designs include conspicuously bulky panels that have hindered creativity by constraining design and have an effect on label placement. Other non-symmetric bottle designs that utilize vacuum panels have been less bulky, more aesthetically pleasing, and allow creative label placement. However, these non-symmetric bottles must be precisely designed which adds significant complexity and cost.

Another solution working along similar principles is the use of active base technology whereby the bottle has a specially-designed base that moves inwardly to displace the volume and compensate for vacuum. Some of these designs are self-activated, or utilize a mechanical piston to push up the base, or some combination of the two. With active base technology there are limitations to final shape geometry since vacuum compensation is limited to the available stroke or the upward movement of the base. If not designed precisely, the use of a piston to drive the base upward can also lead to package distortion which can constrain design freedom. Moreover, the implementation of a puck system at the bottling plant adds significant complexity and cost.

Another technology uses a specially processed base that is activated with heat. Heat causes the material to shrink and the surface of the bottle base is designed so that the shrinkage causes the base to move inward. The activation of this technology is through a machine which rapidly activates the base of the bottle with a heated plate and can also be assisted with a mechanical piston.

Yet another technology involves over-pressurizing the bottle to compensate for vacuum. This is accomplished by dosing the hot-filled bottle with liquid $N_2$ prior to sealing the bottle. Upon dosing, the liquid $N_2$ immediately transforms its state from a cryogenic liquid into a rapidly expanding nitrogen gas thereby pressurizing or charging the bottle after it is sealed. The resultant bottle is then under pressure rather than a vacuum. However, as a result of pressure generated within the container, as well as the large variation in final pressures, a petaloid or pressure-resistant base is required to be incorporated into the bottle design which can be objectionable to consumers. The large variation in final pressure occurs since the pressure is a function of dosage metering precision, distance or time to capping, as well as line smoothness as it relates to product spillage. In addition and most noticeably, the dosing and subsequent pressurization occur while the PET bottle is at its glass transition temperature (Tg). This can result in non-elastic deformation of the bottle and can lead to objectionably low fill points, and other bottle-shape irregularities.

In traditional liquid $N_2$ dosing for water beverages (i.e. a cold-fill process since the water is bottled in a cold condition), the liquid $N_2$ is dosed just prior to capping. While a large variation in final pressure occurs with this type of dosing process for the reasons discussed above, it is used to enhance package performance, in particular top load, since water bottles are quite thin and flimsy in an unpressurized state.

Still another technology involves incorporating a closure containing a pouch filled with an array of active ingredients that can generate $N_2$ gas through an external energy source. After the bottle is filled and capped, and allowed to cool below its glass transition temperature (Tg), electromagnetic induction is externally activated. This starts the reaction which generates $N_2$ within the headspace and compensates for vacuum. Another technology involves the use of absorber materials to relieve vacuum. However, these methods have not yet been proven to be commercially viable as they are cost prohibitive.

Known hot-filled bottles are heavy and are produced in the billions so a savings of several grams per bottle can amount to a substantial overall savings in material. As a result, it is in the interest of bottlers to reduce direct material costs, in particular for PET bottles. It is also in the interest of brand owners to reduce the amount of plastic that are used in their containers to heed public outcry for sustainability and other waste-reduction objectives.

Unfortunately, all of the above known technologies achieve limited weight savings and can restrict bottle design.

Accordingly, there exists a need for a system and method for significantly reducing the weight of hot-filled bottles while reducing the possibility of product spoilage, enhancing the evidence of tampering, imposing no bottle design constraints, eliminating observable low-fill height, and preventing bottle distortion.

SUMMARY OF THE INVENTION

The present teachings provide a method of transferring matter through a sealed container during a bottling process. The method includes providing a container that has been filled with a liquid product and sealed with a closure, the sealed container defining a headspace. The method includes rupturing the sealed container to provide access to the headspace. The method further includes providing an inert gas within the headspace while allowing $O_2$ to exit from the headspace until substantially all of the $O_2$ has been flushed out of the headspace. The method still further includes pressurizing the headspace by continuing to direct the inert gas into the headspace after it has been flushed and sealing the ruptured container while the headspace is under pressure.

The present teachings also provide a bottling system. The bottling system includes a high-speed machine capable of receiving a plurality of filled and sealed containers and including a plurality of stations each capable of receiving an individual filled and sealed container. A rupturing mechanism is arranged to sequentially create at least one opening in each sealed container held in a respective station to provide access to the headspace of the container. An inert gas supply is arranged to direct an inert gas within the headspace of each container while allowing $O_2$ to exit from the headspace until substantially all of the $O_2$ has been flushed out of the headspace and the headspace becomes pressurized by way of the inert gas. A sealing mechanism is arranged to seal the at least opening in each container while the headspace of the container is under pressure.

The present teachings still further provide a method of post-processing a filled and sealed container including a closure and defining a headspace. The method includes accessing the headspace of the filled and sealed container by creating at least one opening. The method includes providing an inert gas within the headspace while allowing $O_2$ to exit from the headspace until substantially all of the $O_2$ has been flushed out of the headspace. The method further includes pressurizing the headspace by continuing to direct the inert gas into the headspace after it has been flushed of $O_2$. The method still further includes sealing the at least one opening of the container while the headspace is under pressure.

Additional features and advantages of various embodiments will be set forth, in part, in the description that follows, and will, in part, be apparent from the description, or may be learned by the practice of various embodiments. The objectives and other advantages of various embodiments will be realized and attained by means of the elements and combinations particularly pointed out in the description herein.

It is to be understood that both the foregoing general description and the following detailed description are exemplary and explanatory only, and are intended to provide an explanation of various embodiments of the present teachings.

DETAILED DESCRIPTION OF THE PREFERRED EMBODIMENTS

The present teachings relate to a system and method that allows for the transfer of matter (i.e. gases, liquids, solids) through a sealed container to flush, pressurize, and seal the container. This method is ideally suited for use with, but not limited to, a hot-fill bottling operation using any type of container, such as a container made from PET. After the beverage container is hot-filled and sealed, the plastic closure and/or plastic bottle can be opened and then flushed, pressurized, and re-sealed by way of (i) a multiple needle approach, or (ii) a rapid cryogenic dosing approach.

According to the present teachings, the bottling process can include the filling of bottles, pouches, tubes, and the like. Moreover, the container can be made from PET, HDPE, LDPE, any polyethylene, polystyrene, or polypropylene material, or any other plastic, rubber, metallic, paper-based, or equivalent container or a container made from a laminate or composite material.

Figure 1:
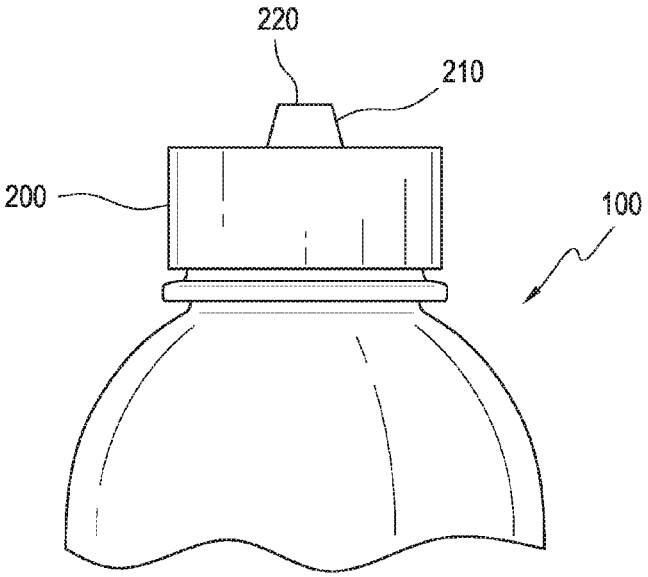
FIG. 1 shows a side view of a closure having an integrally formed protrusion usable with the system and method of the present teachings.

As shown in FIG. 1, an embodiment of a hot-filled and sealed beverage container 100 that can be used with the present teachings is shown. The container 100 can include a closure 200 having a protruded design detail formed on the closure 200, such as a protrusion 210. The protrusion 210 can be arranged at the top of the closure 200. Preferably, the protrusion 210 can be symmetric and centered on the closure 200. The protrusion 210 can be hollow and can be made integrally as part of the closure 200 during the molding process, forming a linerless, or one-piece closure.

The local wall stock forming the protrusion 210 can be as thin as possible to allow for the protrusion to be easily pierced and quickly welded. For example, the protrusion 210 can be a conical-trapezoidal section having a major diameter measured at the base of the protrusion 210 which tapers upwardly to a smaller diameter at the top of the protrusion 210. As will be discussed in more detail below, the top diameter of the protrusion 210 should be large enough to accommodate the penetration of at least two needles through the top of the protrusion 210.

Figure 2:
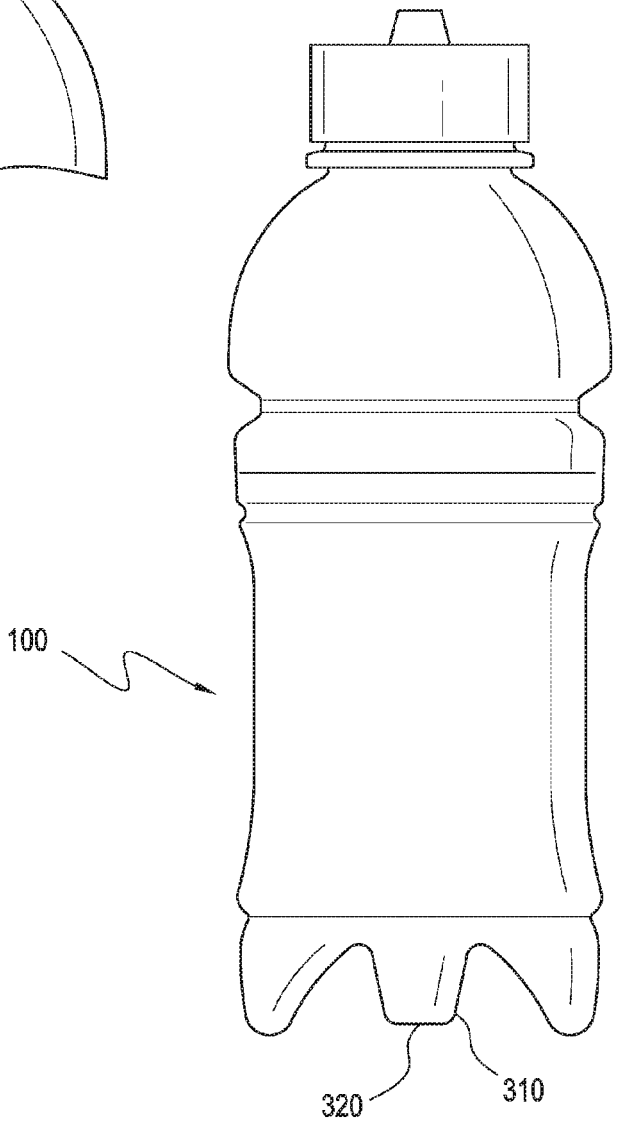
FIG. 2 shows a side view of a protrusion formed in a container base usable with the system and method of the present teachings.

FIG. 2 shows another embodiment of a hot-filled and sealed beverage container 100 that can be used with the present teachings. The container 100 can be constructed having a protruded design detail 310 arranged on the base of the container 100. This protrusion 310 can be symmetric and centered on the base portion of the container 100. The protrusion 310 can be hollow and made integrally as part of the container 100 during the molding process as shown in FIG. 2, or can be a separate piece that attaches to the container 100.

As will be discussed in more detail below with reference to FIGS. 3-12, using the multiple needle post-processing approach of the present teachings, the protrusion 210/310 of a hot-filled container 100 can be ruptured or pierced with multiple needles (thereby forming at least one opening 220 as shown in FIG. 1 or at least one opening 320 as shown in FIG. 2), the headspace can be flushed of $O_2$ using an inert gas and replaced therewith, additional matter can be added (a gas, liquid, and/or solid), the headspace can then be pressurized using the inert gas, and the protrusion 210/310 can then be permanently sealed (e.g. by ultrasonic welding) while still under hermetic lock and while under pressure.

As will be discussed in more detail below with reference to FIGS. 3 and 12-18, using the rapid cryogenic dosing post-processing approach of the present teachings, the protrusion 210/310 of a hot-filled container 100 can be cut open (thereby forming at least one opening 220 as shown in FIG. 1 or at least one opening 320 as shown in FIG. 2), additional matter can be added (a gas, liquid, and/or solid), liquid $N_2$ is dosed into the headspace, the liquid $N_2$ rapidly expands into a gas flushing out $O_2$ from the headspace, and the protrusion 210/310 is then permanently sealed (e.g. by ultrasonic welding) while still under hermetic lock and while under pressure.

The multiple needle approach of the present teachings will now be described in more detail. Initially, the container 100 is hot-filled as would be appreciated by one of ordinary skill in the art but certain adjustments to the closure feeding line can be implemented. These adjustments relate to compensating for the use of the shape of the protrusion 210 and the closure 200 in the present teachings. The adjustments can include adjustments to the orienting and accumulating machines and to capping chucks if there is inadequate space to accommodate the protrusion 210.

Figure 3:
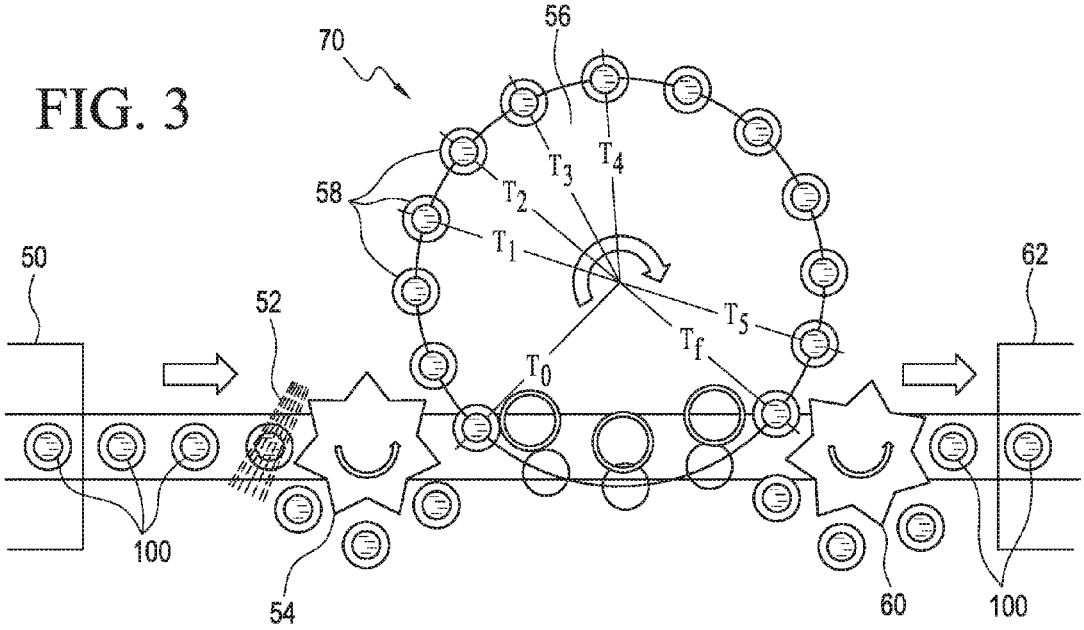
FIG. 3 shows a top view of a rotary machine assembly of the present teachings with a plurality of containers entering therein.

Referring to FIG. 3, after a plurality of containers 100 are hot-filled, sealed, and cooled, the plurality of containers 100 sequentially exit a cooling tunnel 50 and enter a high-speed rotary machine 70 that is similar to a capper machine. A capper machine assembly could be used as the main rotary machine structure 70 as many of the functions that a capper machine performs are required by the present teachings. After exiting the high-speed rotary machine 70, the containers 100 can enter a labeler 62 after which the bottling process can be considered completed.

Just prior to entering a starwheel 54 of the rotary machine 70, a blower 52 can blow the top of the closures 200 dry before the containers 100 are individually positioned within the rotary machine 70. As shown in FIG. 3, the rotary machine 70 can include a rotating turret 56 having several stations 58 where the continuous stream of containers 100 could be processed. For example, the rotating turret 56 can include 16-heads each forming a station where a series of operations can be independently performed to process each individual container 100 according to the present teachings. For example, thirteen containers are shown being processed in FIG. 3 at given positions and times, $T_0$ to $T_5$, on the 16-head rotating turret 56. After processing on the rotating turret 56, the containers 100 can be directed to an exiting starwheel 60 and then can continue on to the labeler 62.

At standard production line rates for hot-filled containers 100, less than about 1.3 seconds of processing time would be available throughout the approximate 270° arc that the rotating turret 56 will rotate. Therefore, every step of the present teachings from $T_0$ to $T_f$ can be executed to the utmost efficiency. For example, the process of the present teachings can result in about 600 bottles per minute to be processed.

Figure 4:
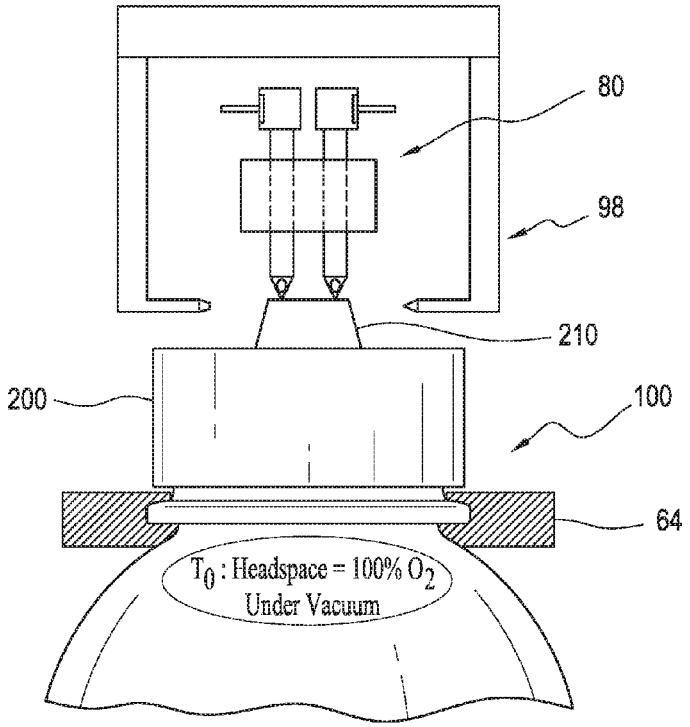
FIG. 4 shows a side view of a container having entered a first station of the rotary machine assembly of FIG. 3 according to an embodiment of the present teachings.

Referring to FIG. 4, a container 100 is shown having entered the high-speed rotary machine 70 at an initial position and time, $T_0$. Initial position and time, $T_0$, is when the headspace within the container is at 100% $O_2$ and under vacuum. The container 100 enters an individual station 58 in a paneled state which means that internal buckling of the container 100 will have already occurred after cooling. The structural design of the container 100 can take into account this initial paneling. A neck support 64 can secure the container 100 by a neck ring or other structure. The neck support 64 can prevent reliance on any container topload which would be compromised at this state. The neck support 64 can locate, vertically move, and provide support to the container 100 through the bottling process of the present teachings.

If the containers 100 include a protruded design detail 310 formed on their respective base, rather than a protrusion 210 formed on their closure 200, then the filled, sealed, cooled, and paneled containers 100 would enter the high-speed rotary machine 70 and be inverted so that each of their bases are in a top position. The remaining processing would be similar to that used with containers 100 having the protrusion 210 on their closures 200.

As shown in FIG. 4, the container 100 and closure 200 can be positioned directly beneath the center of a needle assembly 80 and a welder assembly 98 while the rotating turret 56 of the rotary machine 70 continuously rotates from an initial position and time, $T_0$.

Figure 5:
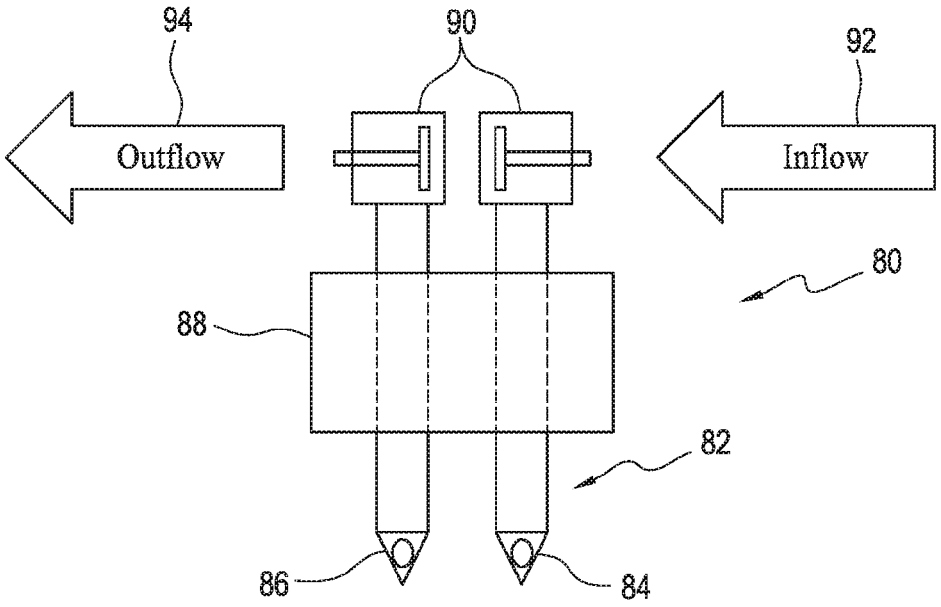
FIG. 5 shows a side view of a dual needle assembly of the present teachings.
Figure 6:
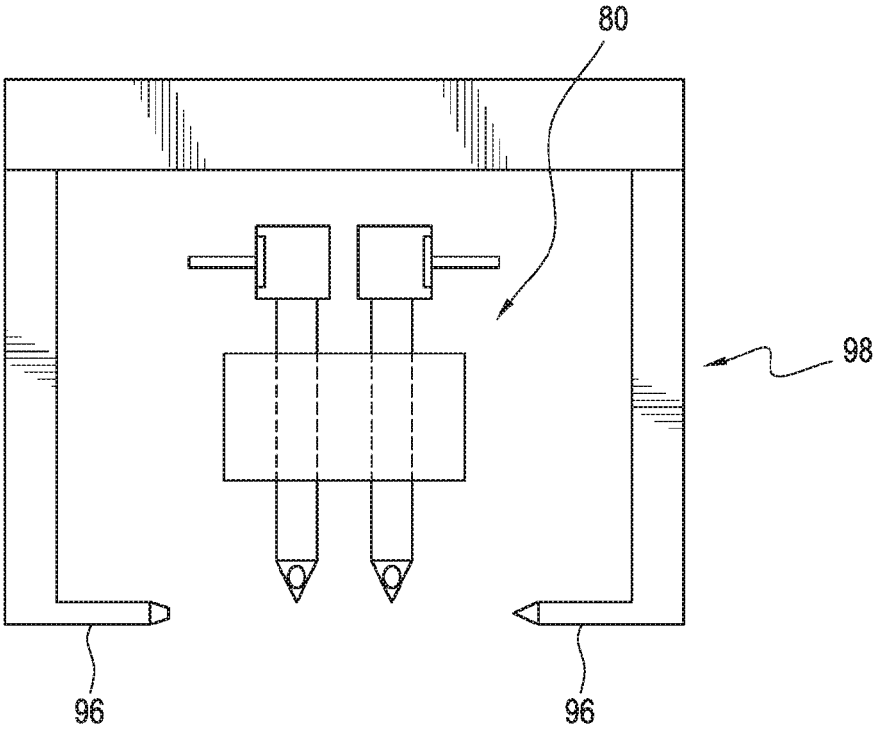
FIG. 6 shows a side view of the ultrasonic welder assembly of the present teachings.

FIG. 5 shows the details of a dual needle assembly 80 while FIG. 6 shows the details of an ultrasonic welder assembly 98. Referring to FIG. 5, a pair of hollow needles or nozzles 82 can be provided and capable of piercing through a material of the closure 200 and allow for the flow of matter (for example, gases) into and out of the headspace of the corresponding container 100. A first needle 84 can be the intake piping for the inflow of a gas into the headspace. A second needle 86 can be the exhaust piping for the outflow (i.e. the flushing) of a gas from the headspace. According to various embodiments, the needles 82 could be made of a food grade steel with enough strength to withstand repeated piercings through a plastic at high speeds.

A heater 88 can be provided to heat the needles 82 to both maintain sterility of the needles 82 and to ease the penetration through the plastic material of the closure 200 or of the container 100. According to various embodiments, the needles 82 can be heated to maintain a substantially constant 185° F. temperature (i.e. the hot-fill temperature) at the needle tips to avoid any adverse sterility conditions and to facilitate the rapid piercing through the plastic. The needle temperature also should not exceed or approximate a temperature that would be detrimental to the material making up the container 100 or the product being filled into the container 100.

A series of valves 90 can be arranged to activate the opening and closing of the gas flow through the needles 82. The valves 90 can be arranged to allow for the opening and closing of passages for the flow of gas to achieve an inflow 92 into the container 100 and an outflow 94 out of the container 100. The intake needle 84 flows gas into the container 100 while the exhaust needle 86 flows gas out of the container 100.

The gas flowing into the headspace of the container 100 can have an adjustable regulator (not shown) that will allow pressurization or charging of the headspace to a predetermined pressure rather than filling by volume. Filling the headspace by regulated pressure rather than by volume will compensate for fill height variations and bottle quality (i.e. dimensional) variations. According to various embodiments, the approximate volume of gas to achieve a 1 to 2 psig charge within the headspace is about 25 $cm^3$ to about 45 $cm^3$.

The ultrasonic welder assembly 98 of FIG. 6 can include two arms 96. One arm can be the horn of the welder and the other arm can be the anvil. The two arms 96 can be capable of moving toward the center of the closure 200 (and nearly impinge) and can then move back to their initial position. In particular, the horn and anvil 96 can be mounted in such a way that they can move toward one another to the center of the protrusion 210 where they perform the weld to seal the protrusion 210, and then they can retract. This is all completed at an accelerated rate. Given the fast speed of the ultrasonic welding technique it is an effective way to seal the protrusion 210 after flushing and pressurizing the container 100.

Figure 7:
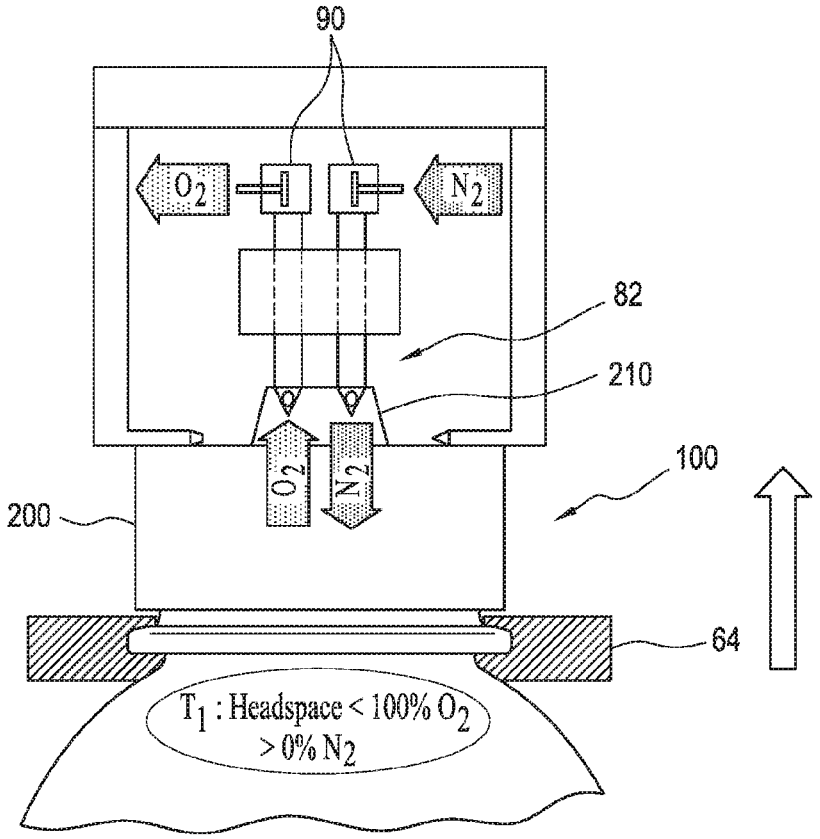
FIG. 7 shows a side view of a container in a top position pierced by the dual needle assembly of the present teachings.

Referring now to FIG. 7, the container 100 is shown having been quickly accelerated upwardly in a vertical direction by the neck support 64 until reaching its top position. In the top position, the top of the protrusion 210 is pierced by the needles 82. The valves 90 are shown moved into an open position allowing for the flow of an insert gas, such as, $N_2$, into the headspace which allows the flushing of $O_2$ out from the headspace and into the atmosphere. This moment in the process is defined as position and time, $T_1$, and it corresponds to the initiation of headspace gas flushing of $O_2$ with inert $N_2$. The headspace at position and time, $T_1$, can be at a pressure of about 1 atm.

Figure 8:
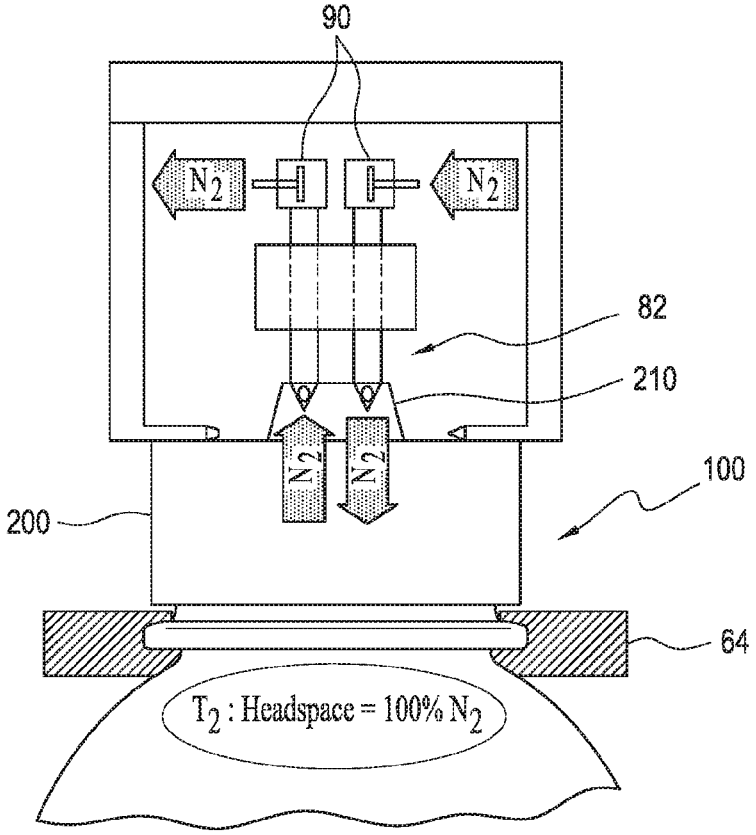
FIG. 8 shows a side view of the container after the headspace has been flushed by the dual needle assembly of the present teachings.

Referring to FIG. 8, the container 100 is shown in a condition once all, or substantially all, of the headspace has been completely flushed of $O_2$. At this point, the headspace is entirely or substantially entirely composed of inert $N_2$. The gaseous $N_2$ continues to flow into the headspace until all remaining $O_2$ is purged and only $N_2$ is flowing from the headspace out into the atmosphere. This is defined as position and time, $T_2$, in the process and the headspace is considered completely flushed.

After flushing, the headspace is ready to be charged with $N_2$.

Figure 9:
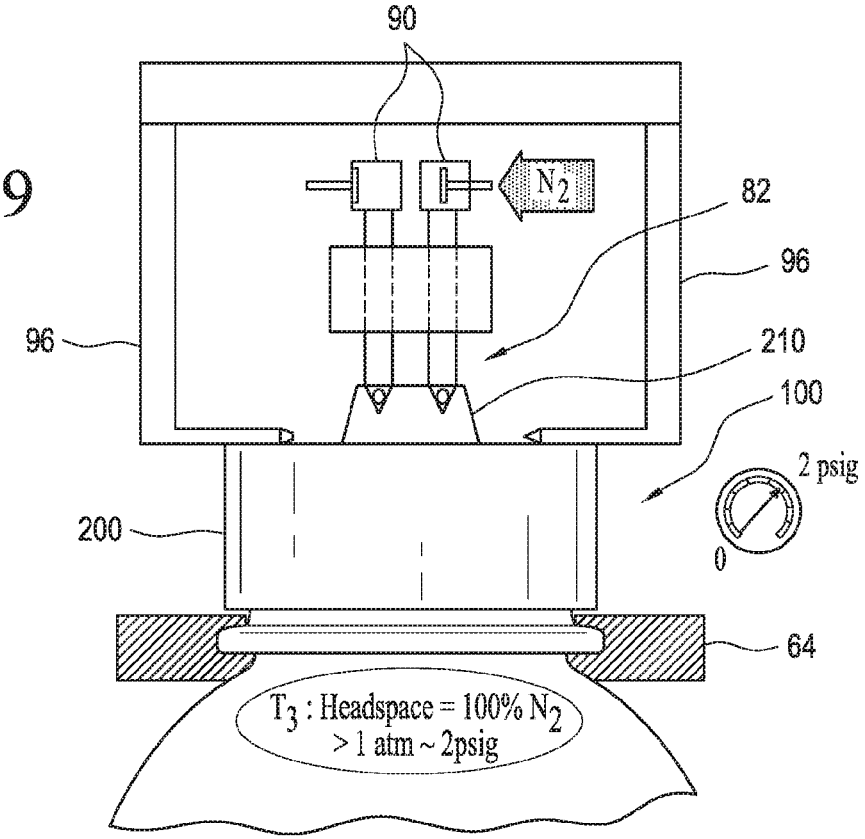
FIG. 9 shows a side view of the container with the headspace being pressurized by the dual needle assembly of the present teachings.

FIG. 9 shows the exhaust valve being closed while the intake valve continues to remain open. This results in the gaseous $N_2$ flowing into the headspace and building up pressure. The headspace can be charged up to about 2 psig which yields excellent top load performance and vending capabilities. This is defined as position and time, $T_3$, in the process and the headspace is considered completely pressurized or charged.

Figure 10:
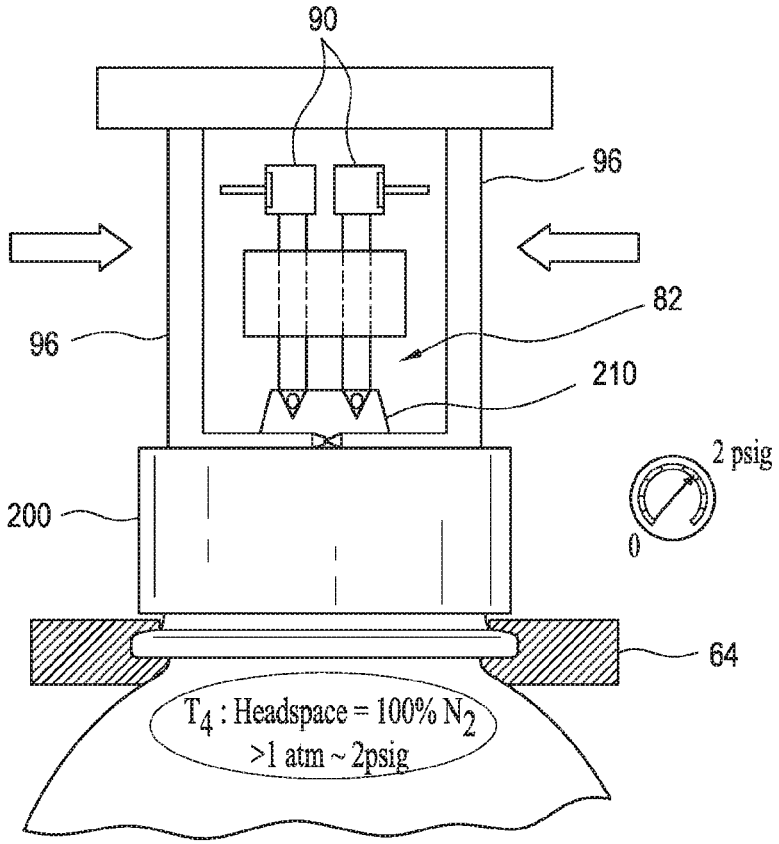
FIG. 10 shows a side view of the container with the welding arms of the ultrasonic welder assembly sealing the headspace according to the present teachings.

Referring to FIG. 10, after the headspace is pressurized and while still being under a hermetic lock with the needle assembly 80, the welding arms 96 can be moved toward the center of the protrusion 210 of the closure 200. The welding arms 96 can rapidly crimp and ultrasonically weld a new seal just below the needles 82. Simultaneously, the welding arms 96 can cut and detach the top part of the protrusion 210. The entire welding operation can occur in a fraction of a second and can be the longest of all of the operations of the present teachings. At this time, both the intake and exhaust valves 90 are closed and they hold the headspace pressure as regulated. This is defined as position and time, $T_4$, in the process.

Figure 11:
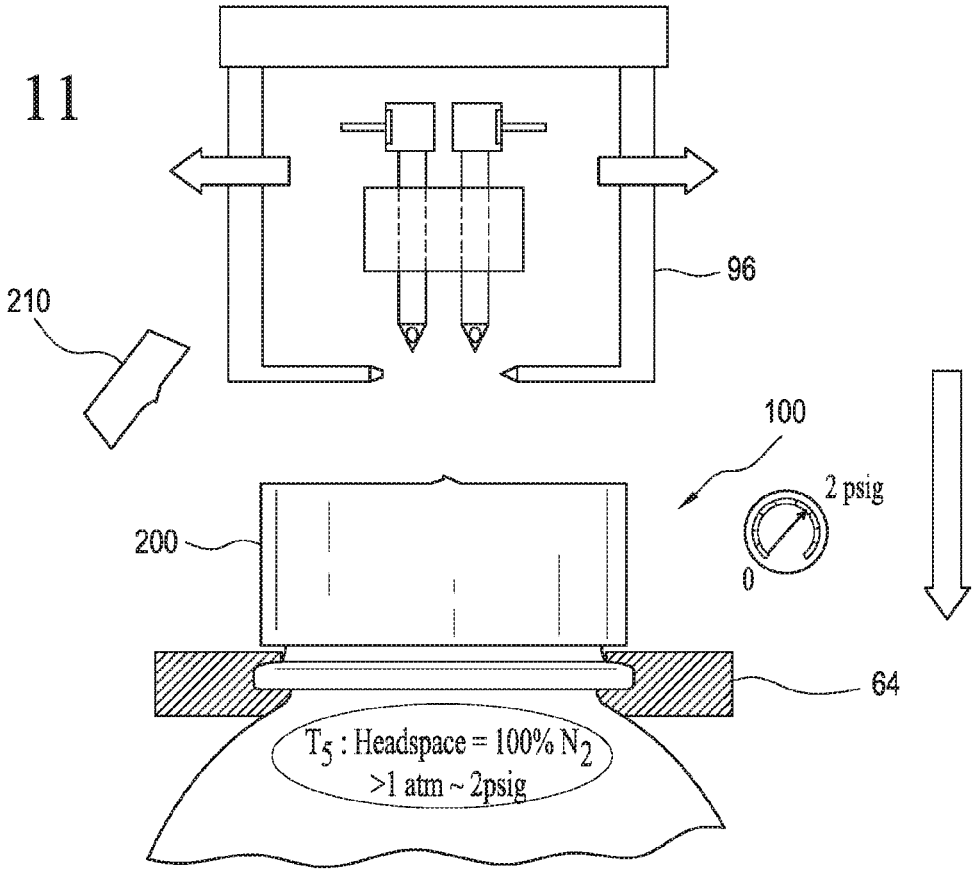
FIG. 11 shows a side view of the container with the welding arms of the ultrasonic welder assembly of the present teachings retracted back to their original position.

Referring to FIG. 11, the welding arms 96 are shown having been quickly retracted back to their original position away from the center of the protrusion 210. The top detached part of the protrusion 210 is separated from the bottom of the protrusion 210 and discarded. The remaining portion of the protrusion 210 is sealed and designed to be as minimal as possible. At this point, the container 100 is quickly accelerated downwardly into its original position of $T_0$. In addition, the headspace of the container 100 is at the desired internal pressure. This is defined as position and time, $T_5$, in the process and the container 100 is flushed, charged, and sealed.

Figure 12:
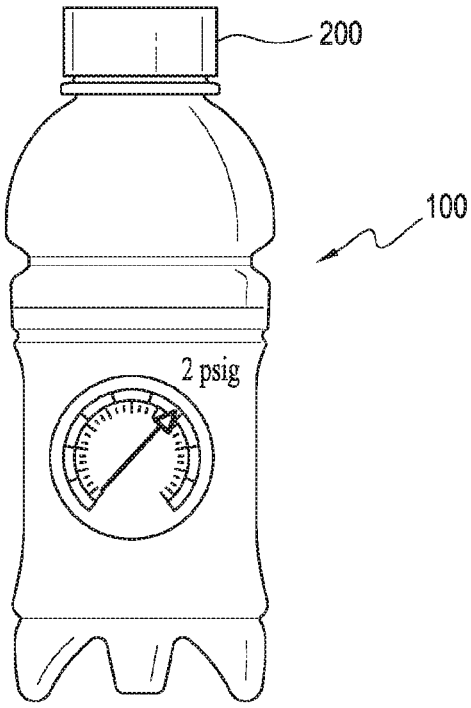
FIG. 12 shows a side view of the container after it has been flushed, pressurized, and sealed by way of the present teachings.

Referring to FIG. 12, the resultant container 100 is shown after the application of the present teachings. This is defined as position, $T_f$, in the process. Specifically, the container 100 is flushed of $O_2$, pressurized, sealed, and will show no indication of low fill height. At this point, the container 100 is ready to continue to the labeler 62 and any other subsequent operations.

According to various embodiments, the container 100 can also be injected with additional matter (e.g. with an additional gas, liquid, and/or solid). For additional injections, one or more additional needles could be added to the needle assembly 80 as required. For example, the system and method of the present teachings could include additional processing steps including the injection of an essence (i.e. a gas), a syrup (i.e. a liquid), and/or inclusions (e.g. solids) into an agnostic or neutral beverage after it has been filled, flushed, pressurized, and sealed. It is common practice in the beverage industry filling lines to batch process for different flavors. A CIP (clean-in-place) process interval occurs in between flavor or product changes. A multi-flavored offering could instead be processed using only its common ingredients. Using this technology downstream, the unique flavor or characteristic could be added and the package labeled accordingly.

The rapid cryogenic dosing approach of the present teachings will now be described in more detail. Initially and similar to the dual needle approach, the containers 100 can be hot-filled in the normal process. They then exit the cooling tunnel 50 and each container 100 enters an individual station 58 within the high-speed rotary machine 70.

Figure 13:
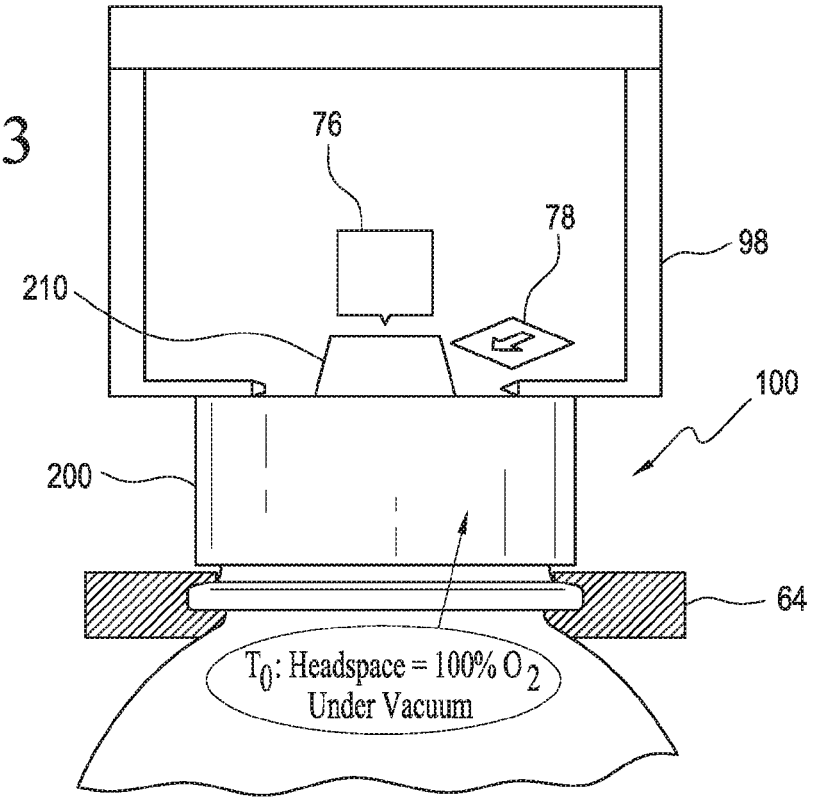
FIG. 13 shows a side view of the container having entered a first station of the rotary machine of FIG. 3 according to another embodiment of the present teachings.

Referring to FIG. 13, a container 100 is shown having entered the high-speed rotary machine 70 at initial position and time, $T_0$. At the initial position and time, $T_0$, the headspace within the container is at 100% $O_2$ and under vacuum. As before, each container 100 enters an individual station 58 in a paneled state and the structural design of the container 100 takes into account this initial paneling. The neck support 64 secures the container 100 by a neck ring or other structure and locates, vertically moves, and provides support to the container 100 through the bottling process.

If the containers 100 include a protruded design detail 310 formed on their bases, rather than a protrusion 210 formed on their closures 200, then the filled, sealed, cooled, and paneled containers 100 would enter the high-speed rotary machine 70 and be inverted so that each of their bases are in a top position. The remaining processing would be similar to that used with containers 100 having the protrusion 210 on their closures 200.

The container 100 and closure 200 can be positioned directly beneath the center of a dosing head assembly 76 and a welder assembly 98 while the rotating turret 56 of the high-speed rotary machine 70 continuously rotates from the initial position and time, $T_0$. A cutting mechanism 78 can be positioned near the protrusion. The cutting mechanism 78 can be a blade.

As such, no needle assembly is used with the rapid cryogenic dosing approach of the present teachings. Instead, in its place a commercially available cryogenic liquid nitrogen doser 76 is implemented.

Figure 14:
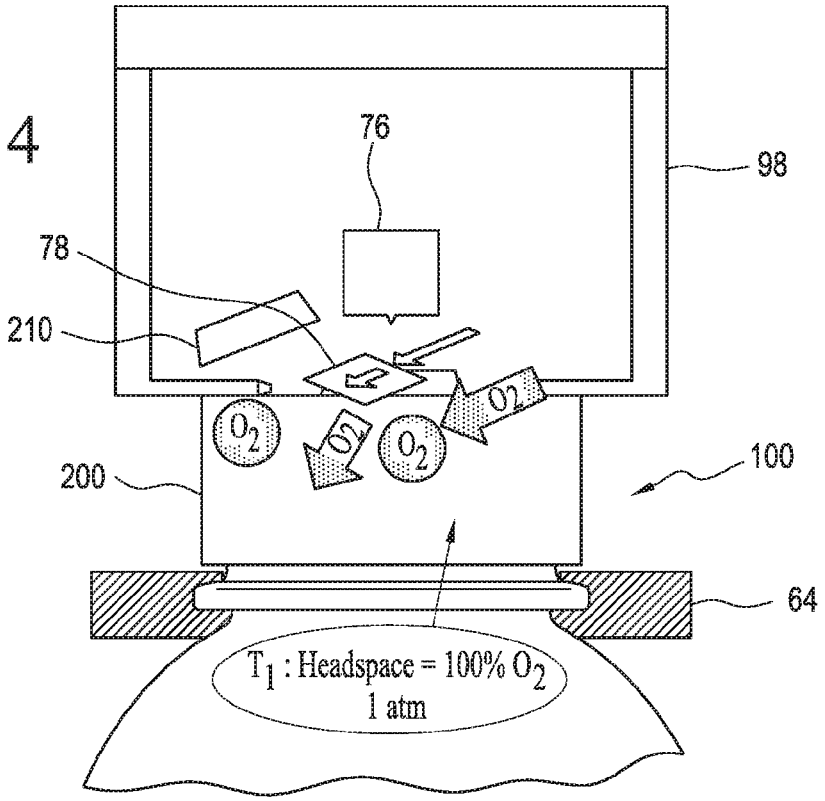
FIG. 14 shows a side view of the container with a protrusion of the closure being ruptured according to the present teachings.

Referring to FIG. 14, the container 100 is shown with the protrusion 210 of the closure 200 having been ruptured. The protrusion 210 can be ruptured by either an already scored or slitted feature around the protrusion 210 and/or by way of cutting or shearing the closure 200 with the cutting mechanism 78 to create an opening. The cutting mechanism 78 can rapidly cut or shear off the top part of the protrusion 210, creating an opening into the container 100. At this point, the vacuum contained within the headspace introduces more $O_2$ into the container 100 as it equalizes under atmospheric pressure. This moment in the process is defined as position and time, $T_1$, and the headspace is at 1 atm.

Figure 15:
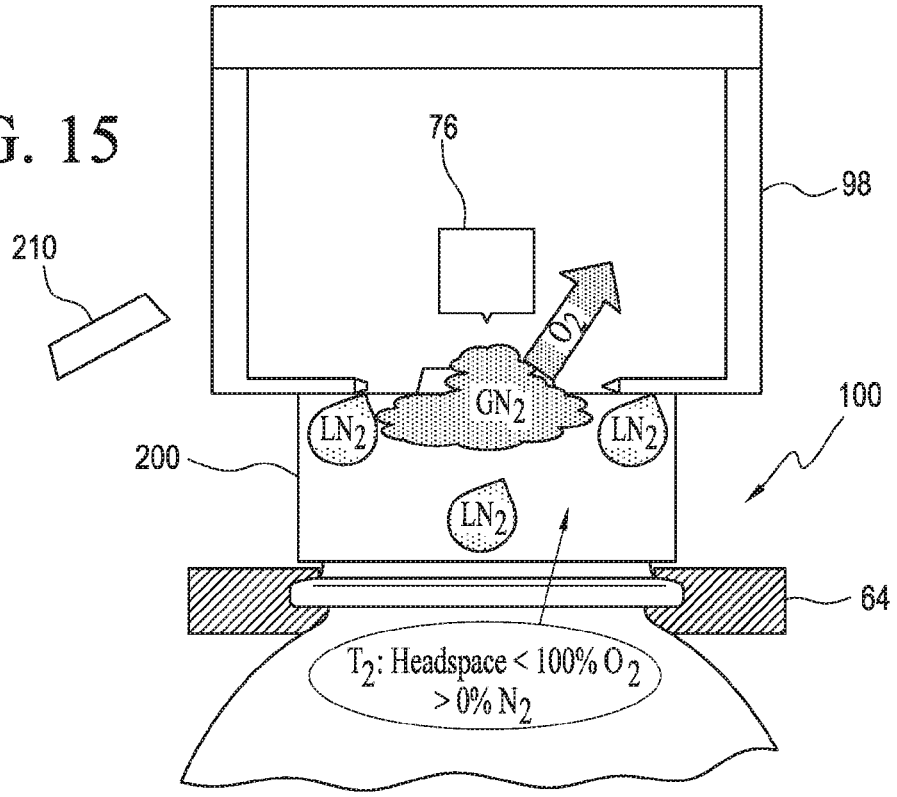
FIG. 15 shows a side view of the container being dosed and the headspace starting to be flushed according to the present teachings.

Referring to FIG. 15, simultaneously upon creating the opening in the protrusion 210, a metered stream of liquid $N_2$ (i.e. $LN_2$) can be dosed into the headspace to quickly flush the headspace of $O_2$. Once dosed, the liquid $N_2$ droplets quickly transform into an expanding gas, $GN_2$ which purges and flushes out the $O_2$ from the headspace. This is defined as position and time, $T_2$, in the process and the headspace begins being flushed.

Figure 16:
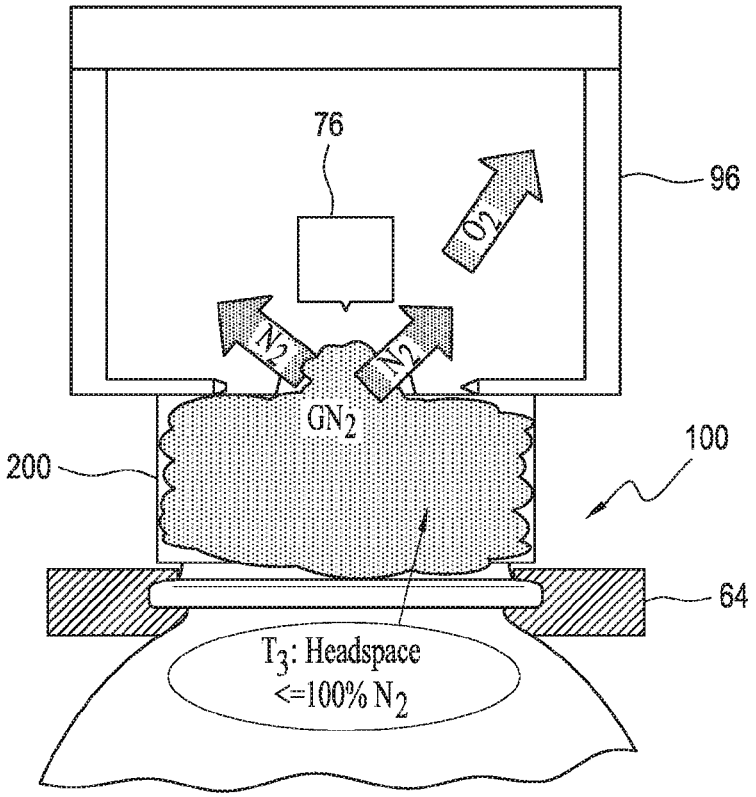
FIG. 16 shows a side view of the container with the headspace being completely flushed and the start of pressurization thereof according to the present teachings.

Referring to FIG. 16, the container 100 is shown in a condition once all, or substantially all, of the headspace has been completely flushed of $O_2$ by the rapidly expanding gas, $GN_2$. At this point, the headspace is entirely or substantially entirely composed of inert $N_2$. The gaseous $N_2$ continues to expand in the headspace until all remaining $O_2$ is purged and only $N_2$ is flowing from the headspace out into the atmosphere. This is defined as position and time, $T_3$, in the process and the headspace is considered completely flushed. This is the start of the pressurization of the headspace with $GN_2$.

Figure 17:
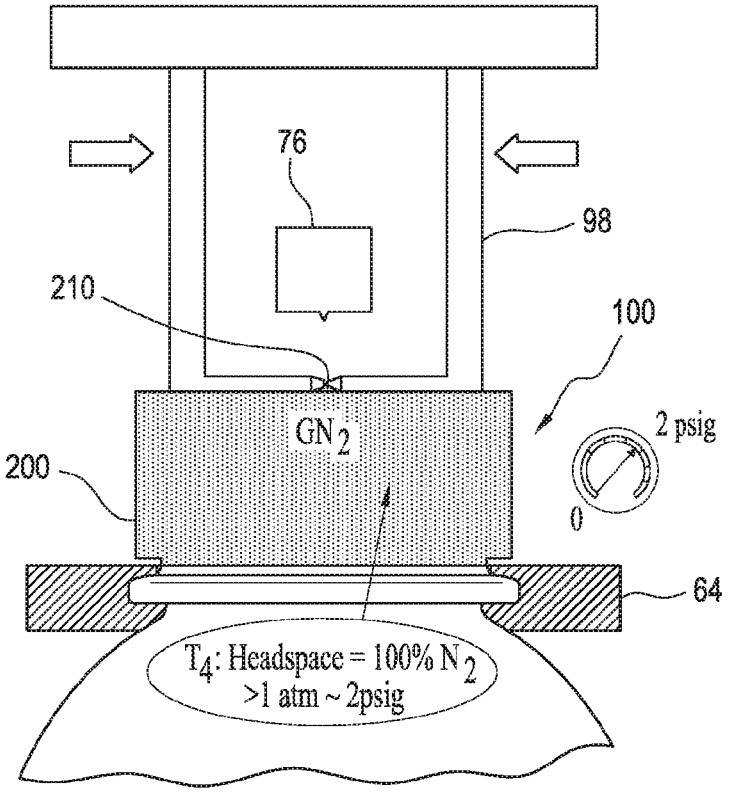
FIG. 17 shows a side view of the container with the welding arms coming together to weld the protrusion and seal the headspace according to the present teachings.

Referring to FIG. 17, while the gas, $GN_2$, is still expanding the protrusion 210 can be ultrasonically sealed and welded, all at a precisely-timed window to capture the low pressure and to render a flushed and charged bottle with no distortion. This is achieved by the welding arms 96 coming together, see arrows, to rapidly crimp and ultrasonically weld a new seal on the protrusion 210 thus sealing the headspace and capturing the pressure generated by the $GN_2$. Simultaneously, the welding arms 96 can cut and detach the top part of the protrusion 210. The entire welding operation can occur in a fraction of a second and can be the longest of all of the operations of the present teachings. This is defined as position and time, $T_4$, in the process.

Figure 18:
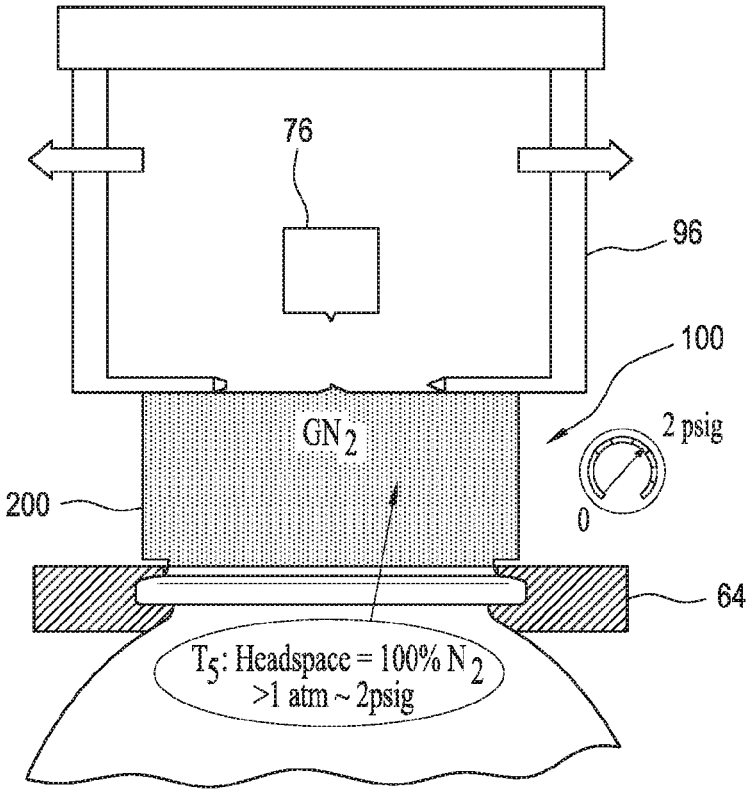
FIG. 18 shows a side view of the container with the welding arms of the ultrasonic welder assembly of the present teachings retracted back to their original position.

Referring to FIG. 18, the welding arms 96 are shown having been quickly retracted back to their original position away from the center of the protrusion 210, see arrows. The top detached part of the protrusion 210 is separated from the bottom of the protrusion 210 and discarded. The remaining portion of the protrusion 210 is sealed and designed to be as minimal as possible. At this point, the container 100 can be quickly accelerated downwardly into its original position of $T_0$. In addition, the headspace of the container 100 is at the desired internal pressure. For example, the headspace can be charged up to about 2 psig which yields excellent top load performance and vending capabilities. This is defined as position and time, $T_5$, in the process and the container 100 is flushed, charged, and sealed.

Referring back to FIG. 12, the resultant container 100 is shown after the application of the rapid cryogenic dosing approach of the present teachings. This is defined as position, $T_f$, in the process. Specifically, the container 100 is flushed of $O_2$, pressurized, sealed, and will show no indication of low fill height. At this point, the container 100 is ready to continue to the labeler 62 and any other subsequent operations.

One significant advantage of the rapid cryogenic dosing approach of the present teachings over conventional $LN_2$ dosing for any hot-fill application is that there is much more precise control over the final package pressure within the bottle given the rapid succession of dosing, flushing, pressurizing, and sealing. This leads to a reduction of variables that have an impact on the resultant pressure.

With the rapid cryogenic dosing approach of the present teachings, substantially the only variable for determining the final pressure is the precision of the dosing equipment since the other variables are substantially eliminated or minimized. Since vacuum has already run its course and as the container is well below its, Tg, there is no need to overcharge the container. As a result, only a low target pressure is required (e.g. from about 1 to 2 psig), no non-elastic deformation of the container will occur, and no special base is required.

Implementing the system and method of the present teachings to fill a container can provide various advantages. For example, they can provide (i) enhanced shelf life through headspace flushing of $O_2$, (ii) ultra-light weighting of the plastic bottle, (iii) enhanced tamper evidence through an auditory cue, (iv) design freedom—absence of (or less reliance on) moveable bases and/or panels, (v) mass product customization of flavored beverages, and (vi) re-carbonation of CSD product near shelf life end.

Regarding advantage (i) above, retardation of product spoilage will occur since the headspace is flushed of $O_2$ with an inert gas (e.g. $N_2$) after the container has been sealed and cooled.

Regarding advantage (ii) above, pressurizing the flushed headspace after the container has been sealed and cooled eliminates internal vacuum, retains the strength and rigidity for both top load and vending requirements, and provides dramatic bottle light-weighting. This allows the creation of hot-filled bottles at water bottle weights.

Regarding advantage (iii) above, a hot-filled container under positive pressure when initially opened will provide an auditory cue resulting from the gushing of the pressurized gas contained within out to the atmosphere. This will provide the user with an additional level of tamper evidence.

Regarding advantage (iv) above, the container is pressurized after it has been filled, sealed, and cooled at a precisely regulated low pressure while being at below its glass transition temperature, Tg. This prevents non-elastic or permanent bottle deformation (low pressure below Tg), the need for a petaloid or pressure-resistant base, a low fill height condition, the need for vacuum panels/reinforcements which allows for container design freedom in areas once constrained for such features, and asymmetric and/or non-standard bottle designs.

Regarding advantage (v) above, when a sudden need for flavored water arises, the particular flavor can be added to these bottles to meet this demand. This allows customization of a product (e.g. adding flavor to "neutral" soda), reduced flavor changeover time at the filling plant, optimized process run, and better utilization of product inventory.

Regarding advantage (vi) above, since a carbonated beverage will lose carbonation over time as $CO_2$ permeates through the container wall, captive warehoused bottles could be reclaimed and recharged (recarbonated), thus extending their shelf life and avoiding product spoilage.

Those skilled in the art can appreciate from the foregoing description that the present teachings can be implemented in a variety of forms. Therefore, while these teachings have been described in connection with particular embodiments and examples thereof, the true scope of the present teachings should not be so limited. Various changes and modifications may be made without departing from the scope of the teachings herein.

What is claimed is:

1. A method of transferring matter through a sealed container during a bottling process comprising:

providing a container that has been filled with a liquid product and sealed with a closure to form the sealed container, the sealed container including a protrusion and defining a headspace having $O_2$ contained within the headspace;

rupturing the protrusion of the sealed container to provide access to the headspace;

flushing the headspace of $O_2$ by providing an inert gas in the headspace for a period of time needed to force $O_2$ to exit from the headspace until substantially all of the $O_2$ has been flushed out of the headspace by way of the inert gas;

pressurizing the headspace by continuing to provide the inert gas in the headspace after the headspace has been flushed of $O_2$; and crimping and sealing the ruptured protrusion while the headspace is under pressure.

2. The method of claim 1, wherein the bottling process is a hot-fill bottling process.

3. The method of claim 2, wherein the container is made of plastic.

4. The method of claim 1, wherein rupturing the protrusion of the sealed container includes creating at least one opening in one of the closure and a base of the container.

5. The method of claim 4, wherein rupturing the protrusion of the sealed container includes creating at least two openings using a multi-needle assembly.

6. The method of claim 5, wherein a first needle of the multi-needle assembly creates a first opening and directs the inert gas into the headspace and the second needle of the multi-needle assembly creates a second opening and directs the $O_2$ out of the headspace.

7. The method of claim 5, wherein sealing the ruptured protrusion includes ultrasonically welding the at least two openings.

8. The method of claim 4, wherein flushing the headspace of $O_2$ by providing an inert gas into the headspace includes dosing a liquefied inert gas into the headspace and allowing it to rapidly expand into a gas until substantially all of the $O_2$ has been flushed out of the headspace by way of the inert gas.

9. The method of claim 8, wherein sealing the ruptured protrusion includes ultrasonically welding the at least one opening.

10. A bottling system comprising:

a high-speed machine capable of receiving a plurality of filled and sealed containers each including a protrusion and defining a headspace having $O_2$ contained within the headspace, the high-speed machine including a plurality of stations each capable of receiving an individual filled and sealed container;

a rupturing mechanism arranged to sequentially create at least one opening in the protrusion of each sealed container held in a respective station to provide access to the headspace of the container;

an inert gas supply arranged to provide an inert gas in the headspace of each container for a period of time needed to force the $O_2$ to exit from the headspace until substantially all of the $O_2$ has been flushed out of the headspace by way of the inert gas and configured to then continue to provide the insert gas in the headspace after the headspace has been flushed such that the headspace becomes pressurized by way of the inert gas; and a crimping and sealing mechanism arranged to crimp and then seal the at least one opening in the protrusion of each container while the headspace of the container is under pressure.

11. The bottling system of claim 10, wherein the high-speed machine is capable of receiving a plurality of hot-filled and sealed containers.

12. The bottling system of claim 11, wherein the supply of inert gas is a rapid cryogenic doser mechanism that is arranged to direct a liquified inert gas into the headspace.

13. The bottling system of claim 12, wherein the crimping and sealing mechanism includes an ultrasonic welder.

14. The bottling system of claim 10, wherein the rupturing mechanism is capable of creating the at least one opening in the protrusion formed in one of the closure and a base of the sealed containers.

15. The bottling system of claim 14, wherein the rupturing mechanism includes a multi-needle assembly and is capable of creating at least two openings in the protrusion of each sealed container.

16. The bottling system of claim 15, wherein a first needle of the multi-needle assembly is capable of creating a first opening and directing the inert gas within the headspace of each sealed container and the second needle of the multi-needle assembly is capable of creating a second opening and directing the $O_2$ out of the headspace of each sealed container.

17. The bottling system of claim 15, wherein the crimping and sealing mechanism is an ultrasonic welder.

18. A method of post-processing a filled and sealed container including a closure and defining a headspace comprising:

accessing the headspace of the filled and sealed container by creating at least one opening, the headspace having $O_2$ contained therein;

providing an inert gas in the headspace while simultaneously allowing outflow of $O_2$ from the headspace for a period of time required until substantially all of the $O_2$ has been flushed out of the headspace;

pressurizing the headspace by continuing to provide the inert gas in the headspace after it has been flushed of $O_2$; and non-pneumatically sealing the at least one opening of the container while the headspace is under pressure.

19. The post-processing method of claim 18, wherein the filled and sealed container is a hot-filled container.

20. The post-processing method of claim 18, wherein non-pneumatically sealing the ruptured container includes ultrasonically welding the at least one opening.

* * * * *